US008939527B2

(12) United States Patent
Shinohara et al.

(10) Patent No.: US 8,939,527 B2
(45) Date of Patent: Jan. 27, 2015

(54) PRINTING APPARATUS

(71) Applicant: Canon Kabushiki Kaisha, Tokyo (JP)

(72) Inventors: Shimpei Shinohara, Yokohama (JP); Takeshi Sekino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/869,517

(22) Filed: Apr. 24, 2013

(65) Prior Publication Data

US 2013/0300784 A1 Nov. 14, 2013

(30) Foreign Application Priority Data

May 8, 2012 (JP) ..... 2012-106984

(51) Int. Cl.

| | |
|---|---|
| ***B41J 29/38*** | (2006.01) |
| ***B41J 23/00*** | (2006.01) |
| ***B41J 2/17*** | (2006.01) |
| ***B41J 29/02*** | (2006.01) |
| ***B41J 19/20*** | (2006.01) |
| ***B41J 25/308*** | (2006.01) |

(52) U.S. Cl.

CPC ..... *B41J 2/1707* (2013.01); *B41J 29/02* (2013.01); *B41J 29/38* (2013.01); *B41J 19/202* (2013.01); *B41J 25/3086* (2013.01)

USPC ..... 347/6; 347/38; 347/39

(58) Field of Classification Search

None

See application file for complete search history.

(56) References Cited

FOREIGN PATENT DOCUMENTS

| | | | | |
|---|---|---|---|---|
| JP | 2007-160716 | * | 6/2007 | ..... B41J 2/175 |
| JP | 2007-331307 A | | 12/2007 | |

* cited by examiner

*Primary Examiner* — Geoffrey Mruk

(74) *Attorney, Agent, or Firm* — Fitzpatrick, Cella, Harper & Scinto

(57) ABSTRACT

An ink jet printing apparatus can suppress vibrations to a low level without local concentration of abrasion between a carriage and a guide shaft. The ink jet printing apparatus makes the carriage reciprocate along the guide shaft without ejecting ink, thus achieving a stirring operation in which the ink stored in an ink tank is stirred. At least one of a limited range in one direction, in which the stirring operation is performed, and a portion of the guide shaft that contacts the carriage when viewed from the one direction, is changeable.

10 Claims, 11 Drawing Sheets

| STIRRING MODE | RADIUS R OF GUIDE SHAFT CAM | POSITION OF RECIPROCATING MOTION OF CARRIAGE IN X DIRECTION AT TIME OF STIRRING OPERATION | ROTATIONAL ANGLE θ OF GUIDE SHAFT | HEIGHT OF CARRIAGE IN Z DIRECTION |
|---|---|---|---|---|
| TYPE A | R2 | $X_R$ | θ2 | Z2 |
| TYPE B | R2 | $X_L$ | θ2 | Z2 |
| TYPE C | R3 | $X_R$ | θ3 | Z3 |
| TYPE D | R3 | $X_L$ | θ3 | Z3 |

FIG.10

| STIRRING TIMING | STIRRING MODE |
|---|---|
| 1 MANUAL STIRRING | TYPE D |
| 2 INK TANK REPLACEMENT | TYPE C |
| 3 PRINT HEAD RECOVERY | TYPE A |
| 4 TIMER INTERRUPTION | TYPE B |
| 5 POWER ON | TYPE A |

FIG.11

PRINTING APPARATUS

BACKGROUND OF THE INVENTION

1. Field of the Invention

The present invention relates to a printing apparatus, in which ink reserved or stored in an ink tank is stirred, and a stirring method in the printing apparatus.

2. Description of the Related Art

An ink jet printing apparatus for ejecting ink from a print head so as to perform printing has been widely adopted as a printing apparatus. As the ink for use in such an ink jet printing apparatus, a dye ink containing a dye as a colorant and a pigment ink using a pigment as a colorant have been used in most cases. Among these kinds of ink, in the case of a pigment ink, a pigment component may be precipitated to be coagulated in the ink when the pigment ink is left unused during a long period of time. Therefore, when the ink is ejected onto a print medium, the density of droplets of the ejected ink depends on a landing position, thereby inducing variations of the density. Consequently, a print image has inconsistencies in color or the like. The inconsistencies may adversely influence the print image.

In view of this, there has been proposed an ink jet printing apparatus in which ink is periodically stirred inside of an ink tank in order to prevent the pigment from being unevenly collected inside of the ink tank. Japanese Patent Laid-open No. 2007-331307, for example, discloses an ink jet printing apparatus in which a stirring level is adjusted according to a lapse of time after a previous stirring operation and the residual amount of ink reserved in an ink tank.

In the ink jet printing apparatus disclosed in Japanese Patent Laid-open No. 2007-331307, a carriage having a print head and an ink tank mounted thereon reciprocates along a guide shaft without performing any printing operation, thus stirring ink inside of the ink tank. Japanese Patent Laid-open No. 2007-331307 is silent about the position of the stirring operation. Normally, an ink stirring operation is performed inside of the ink tank when the carriage is moved to a predetermined position. However, in the case where the stirring operation is performed at a determined position, the sliding frequencies of members are different between the position at which the stirring operation is performed and other positions. Consequently, there arises a difference in abrasion level between the carriage and the guide shaft.

If abrasion promotes only at a part between the carriage and the guide shaft, the friction levels are different between a relatively large abraded portion and other portions. Therefore, when the carriage is moved along the guide shaft, vibrations become larger at a portion at which the abrasion level is varied, thereby inducing a possibility of degradation of landing accuracy of an ink droplet onto a print medium. In this manner, there is a possibility of degradation of the quality of a print image.

SUMMARY OF THE INVENTION

In view of the above-described circumstance, an object of the present invention is to provide a printing apparatus in which vibrations are suppressed without any difference in abrasion level between a carriage and a guide member, and a stirring method.

According to an aspect of the present invention, there is provided a printing apparatus comprising: a carriage holding a print head and an ink tank, configured to reciprocate along a guide in a direction; and a controller for performing stirring of ink in the ink tank by reciprocating the carriage within a limited range without ejecting ink from the print head, wherein, for the stirring, at least one of the limited range in the direction and a portion of the guide that contacts the carriage when seeing from the direction, is changeable.

According to an aspect of the present invention, there is provided a printing apparatus comprising: a carriage holding a print head and an ink tank, configured to reciprocate along a guide shaft in a direction; and a controller for performing stirring of ink in the ink tank by reciprocating the carriage within a limited range without ejecting ink from the print head, wherein, for the stirring, at least one of the limited range in the direction and a rotational angle of the guide shaft is changeable.

According to the present invention, the abrasion between the carriage and the guide member is scattered, thereby suppressing slidability from being largely changed at the carriage and the guide member due to the local concentration of abrasion. In this manner, the slidability can be suppressed from being largely changed between the carriage and the guide member, and therefore, vibrations can be suppressed from being generated during scanning by the carriage. Consequently, it is possible to suppress an ink landing accuracy from being degraded during a printing operation, and further, concentration variations from being generated at a print image.

Further features of the present invention will become apparent from the following description of an exemplary embodiment with reference to the attached drawings.

BRIEF DESCRIPTION OF THE DRAWINGS

FIG. 10 is a table illustrating guide shaft cam radii, carriage positions, guide shaft rotational angles, and carriage heights according to stirring modes in the ink jet printing apparatus shown in FIG. 1; and FIG. 11 is a table illustrating the stirring modes according to stirring timings, respectively, in the ink jet printing apparatus shown in FIG. 1.

DESCRIPTION OF THE EMBODIMENTS

Figure 1:
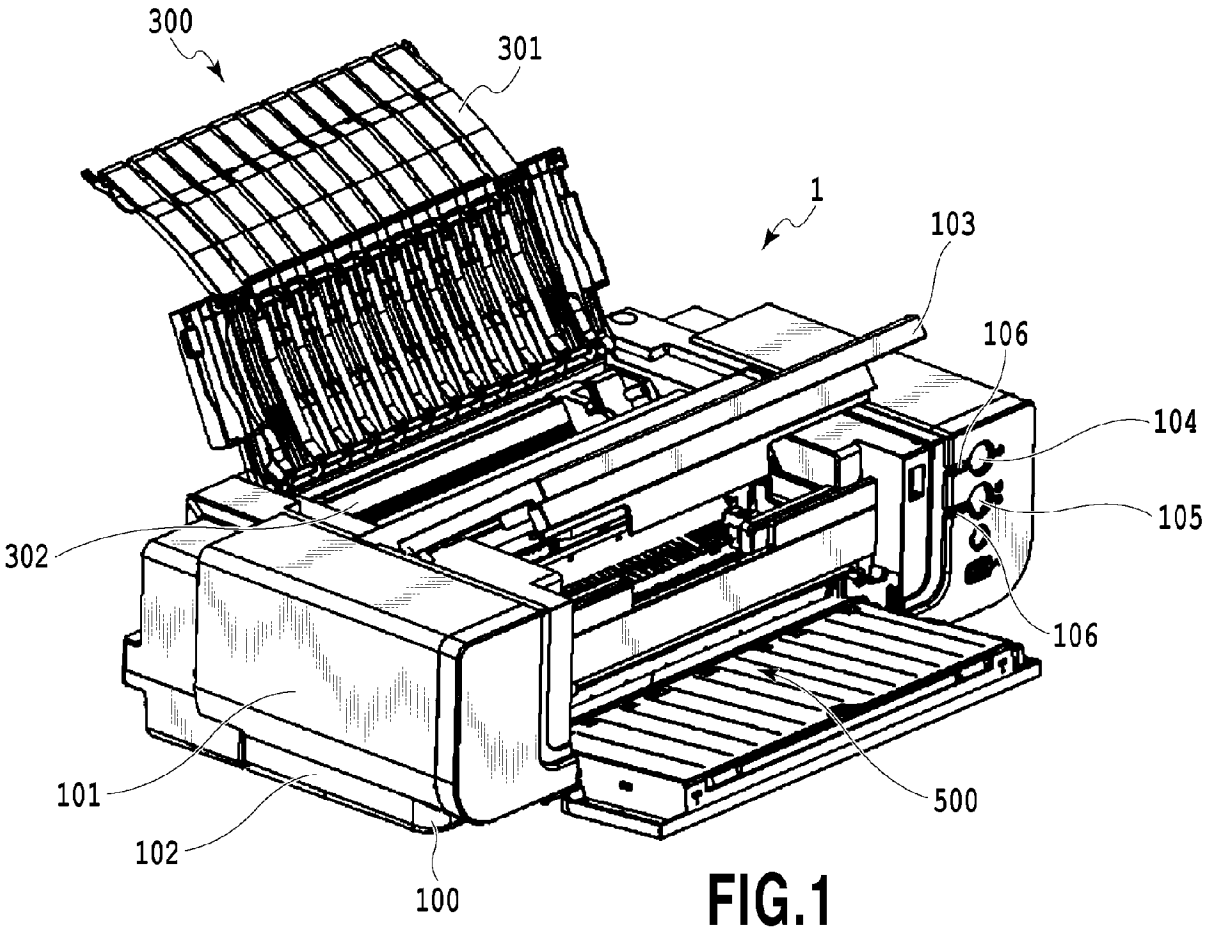
FIG. 1 is a perspective view showing an ink jet printing apparatus in an embodiment according to the present invention.

An ink jet printing apparatus 1 in an embodiment according to the present invention will be described with reference to the attached drawings. FIG. 1 is a perspective view showing the ink jet printing apparatus 1 in an embodiment. In the ink jet printing apparatus 1 in the present embodiment, a carriage 601 having a print head 700 and an ink tank 602 mounted thereon is housed inside of a casing 100. The casing 100 is constituted of mainly an upper case 101 and a lower base 102.

The casing 100 for the ink jet printing apparatus 1 is provided with an access cover 103. The access cover 103 is provided such that its end can be turned with respect to the upper case 101 for the casing 100. When the access cover 103 is opened, an access can be made from the outside with respect to component parts such as the print head 700 or the ink tank 602 housed inside of a printing apparatus main body 100, and therefore, these component parts can be replaced with new ones.

A power key 104 and a resume key 105 are disposed in a pressable manner in front of the casing 100 in the ink jet printing apparatus 1. Moreover, a light guide 106 is provided at the casing 100 in such a manner as to extend from each of the power key 104 and the resume key 105. Each of the light guides 106 is adapted to guide and diffuse light emitted from a light emitting diode (hereinafter referred to as an "LED") mounted on an operational board to the outside. The LED lights or flashes so as to notify the user of various conditions such as ON or OFF of a power source in the ink jet printing apparatus 1. In this manner, the ink jet printing apparatus 1 is equipped with a display function of displaying the condition thereof by transmitting the light emitted from the LED to the user via the light guide 106.

Figure 2:
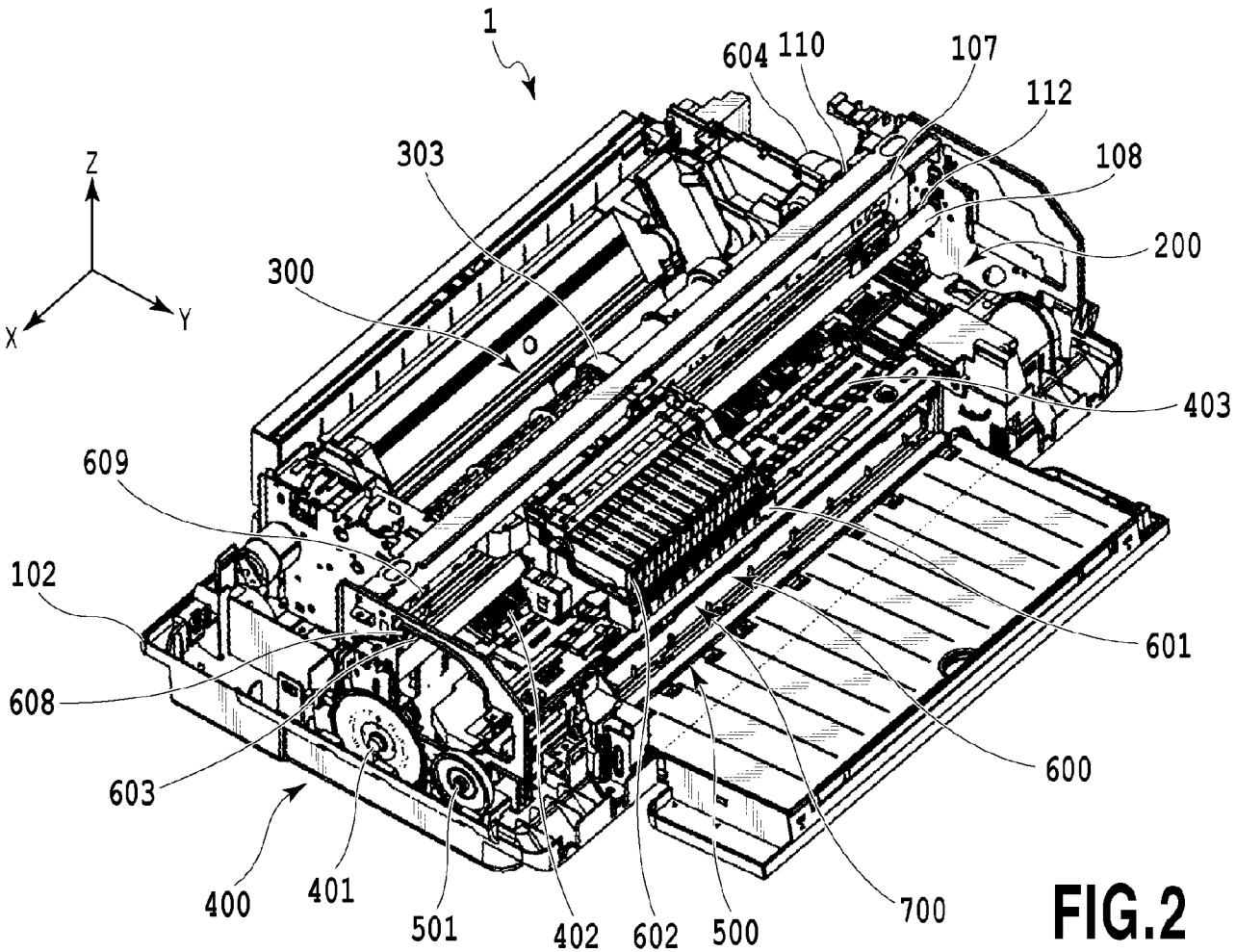
FIG. 2 is a perspective view showing the inside configuration of the ink jet printing apparatus shown in FIG. 1 in the state in which an upper case is detached.

FIG. 2 is a perspective view showing the ink jet printing apparatus 1 in the present embodiment when the upper case 101 is detached in order to show the inside configuration. The ink jet printing apparatus 1 includes a head recovery unit 200, a sheet feeder unit 300, a conveyor unit 400, a sheet discharge unit 500, and a printing unit 600. The head recovery unit 200, the sheet feeder unit 300, the conveyor unit 400, the sheet discharge unit 500, and the printing unit 600 are mounted on the lower base 102.

The printing unit 600 is constituted of the print head 700 capable of ejecting ink, the ink tank 602 capable of reserving the ink therein, and a carriage 601 capable of mounting the print head 700 and the ink tank 602 thereon. The carriage 601 can reciprocate in a direction (i.e., an X direction) crossing a recording sheet conveyance direction (i.e., a Y direction) with the print head 700 and the ink tank 602 mounted thereon.

Figure 3:
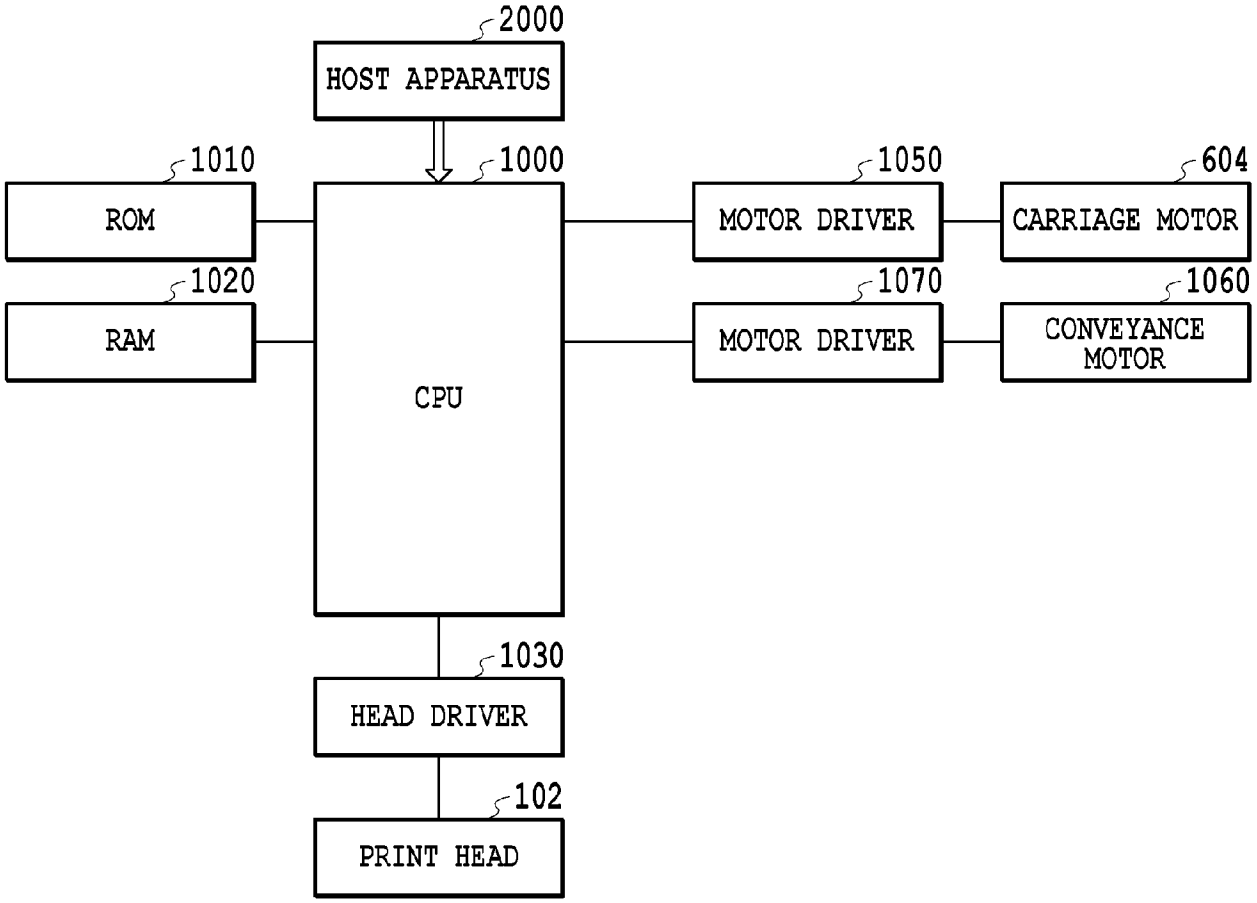
FIG. 3 is a block diagram illustrating a control system in the ink jet printing apparatus shown in FIG. 1.

FIG. 3 is a block diagram illustrating a control system in the ink jet printing apparatus in the present embodiment. A CPU 1000 performs various kinds of operation controlling processing, data processing, and the like in response to an output from a host apparatus 2000. A ROM 1010 stores therein programs for the processing procedures and the like. Moreover, a RAM 1020 is used as a work area for performing the processing. When the ink is ejected from the print head 102, drive data (i.e., image data) and a drive control signal for driving a print element by the CPU 1000 are supplied to a head driver 1030. The CPU 1000 controls a carriage motor 604 for driving the carriage 601 in a main scanning direction via a motor driver 1050. Moreover, the CPU 1000 controls a conveyance motor 1060 for conveying the recording sheet via another motor driver 1070. In the present embodiment, the ROM 1010, the RAM 1020, and the CPU 1000 function as a print control unit for controlling a printing operation.

When the ink jet printing apparatus 1 performs a printing operation, the host apparatus 2000 first sends print data to the CPU 1000 in the ink jet printing apparatus 1. The print data is temporarily stored in a control unit such as the ROM 1010 or the RAM 1020 on a control board. And then, the control unit issues a printing operation start command, so that the ink jet printing apparatus 1 starts a printing operation.

As shown in FIG. 2, the plurality of print heads 700 and the plurality of ink tanks 602 that correspond to colors are mounted on the carriage 601. Ink reserved in each of the ink tanks 602 is supplied to each of ink channels through ink supply ports formed at the print head 700. The ink that is supplied to each of the ink channels through each of the ink supply ports forms a meniscus at an ejection port which is the tip of the ink channel, and thus, can be stably held. In the present embodiment, each of the ink channels is provided with a heat generating element (i.e., an electrothermal transducer). The heat generating elements are selectively energized, to then generate thermal energy, so that the ink staying in the ink channel is heated to make foams by film boiling. Foaming energy generated at this time ejects an ink droplet through the ejection port.

Here, although the drive of the heat generating element generates the foams in the ink, and then, the foaming energy at this time ejects the ink droplet through the ejection port in the present embodiment, the present invention is not limited to this. Examples of a system for ejecting ink include a system using a piezoelectric element, a system using an electrostatic element, and a system using an MEMS element in addition to a system using a heater.

The head recovering unit 200 is provided for performing a recovering operation so as to hold an excellent ejection state of the print head 700. The head recovering unit 200 has a cap. The cap is adapted to cap the ejection port of the print head mounted on the carriage 601. When the ejection port is capped, and further, the inside of the cap is reduced in pressure in a sealed state, the ink is sucked through the ejection port, thereby recovering the ink having an increased viscosity and staying around the ejection port or waste contained in the ink. Consequently, the ink ejection state of the ejection port can be normally recovered.

When a printing operation is performed, the recording sheet as a print medium, not shown, is stacked on the sheet feeder 300. The recording sheet is fed by the sheet feeder 300 disposed in the ink jet printing apparatus 1. During a sheet feeding operation, the recording sheet stacked on a sheet feed tray 301 is fed through a sheet feed port 302. Thereafter, the recording sheet is conveyed in a sub scanning direction indicated by the arrow Y shown in FIG. 2 by conveyance rollers. During the conveyance, the recording sheet is conveyed toward a nip unit constituted of a conveyance roller 401 and a pinch roller 402, both of which are arranged in the conveyor unit 400. When the recording sheet reaches between the conveyance roller 401 and the pinch roller 402, a sheet feed roller 303 is stopped to be driven, to be thus rotated together with the recording sheet. At this time, the sheet is conveyed only by the conveyance roller 401 and the pinch roller 402.

When the recording sheet is conveyed at a position facing the print head 700 through the conveyor 400, the ink jet printing apparatus 1 starts a printing operation with respect to the recording sheet. During the printing with respect to the recording sheet, a printing operation and a conveying operation are repeated. In the printing operation, the print head 700 is moved in a main scanning direction while the ink is ejected toward a print area of the recording sheet placed on a platen 403. In the conveying operation, the recording sheet is conveyed in the sub scanning direction by a distance corresponding to a print length in the printing operation. The printing operation and the conveying operation are repeated, so that images are sequentially printed on the recording sheet. At this time, the recording sheet is conveyed along a rib disposed on the platen 403 every predetermined line. The recording sheet gradually reaches a nip unit constituted of a first sheet discharge roller 501 and a first spur array. Here, the first sheet discharge roller 501 is rotated in synchronism with the conveyance roller 401. Therefore, a proper tension is kept with respect to the recording sheet while the recording sheet is conveyed. In this manner, the recording sheet having the image printed thereon is conveyed to the sheet discharge unit 500, to be then discharged to the outside of the printing apparatus.

The platen 403 supports the recording sheet on the support surface thereof during the printing operation. The support surface of the platen 403 faces a surface, at which the ejection ports are formed, of the print head 700 reciprocated by the carriage 601 with a preset clearance in a Z direction. The carriage 601 is guided and supported by a guide shaft (i.e., a guide member) 108 and a support rail (i.e., a support member) 107 securely mounted on a chassis 110. The guide shaft 108 is supported by the chassis 110 extending from the lower base 102 of the casing 100 in the ink jet printing apparatus 1. The carriage 601 has a through hole 701 formed in such a manner as to penetrate the carriage 601 in the main scanning direction. The guide shaft 108 is arranged in such a manner as to penetrate the carriage 601 through the through hole 701. Inside of the through hole 701 is disposed a carriage bearing 606. In other words, the carriage 601 is supported by the guide shaft 108 via the carriage bearing 606. The carriage bearing 606 is such configured as to freely slide on the guide shaft 108.

In the present embodiment, in order to suppress the rotation of the carriage 601 on the guide shaft 108, the support rail 107 extending in parallel to the guide shaft 108 is fixed to the chassis 110 on the main body side of the ink jet printing apparatus 1. That is to say, the posture of the carriage 601 is held by the slide on the support rail 107. As described later, the guide shaft 108 is disposed in a relatively movable manner with respect to the main body of the ink jet printing apparatus 1 by guide shaft cams 109. However, the support rail 107 is securely fixed to the chassis 110 on the main body side. Consequently, in the present embodiment, the support rail 107 cannot be moved relatively to the main body of the ink jet printing apparatus 1.

Figure 9A:
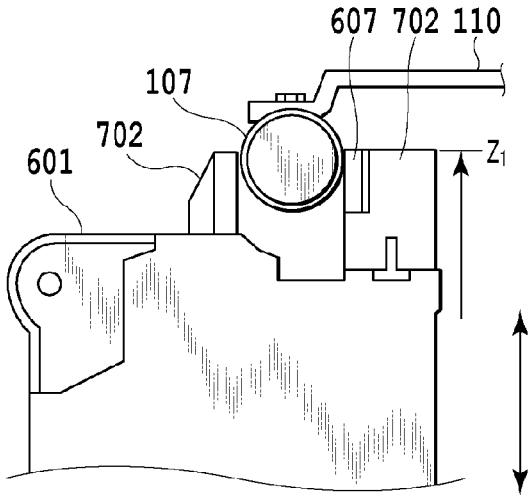
FIGS. 9A to 9C are side views showing the carriage and the support rail at varied heights of the guide shaft and the carriage in the ink jet printing apparatus shown in FIG. 1.
Figure 9B:
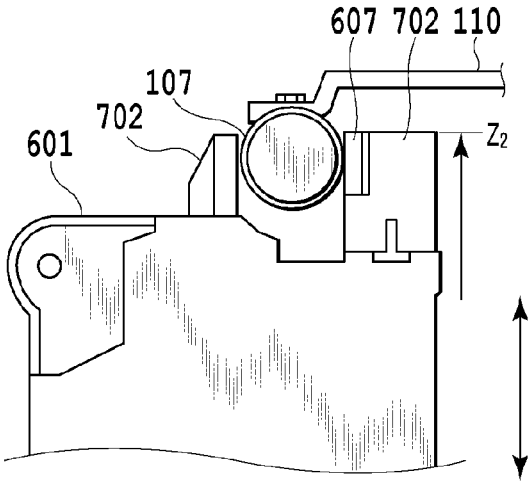
Figure 9C:
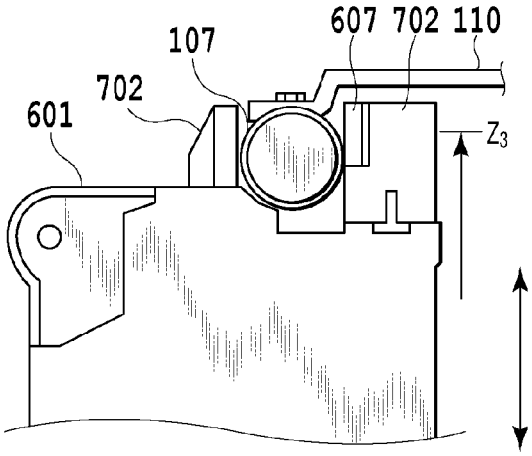

As shown in FIGS. 9A to 9C, two projecting portions 702 projecting from the upper surface are formed at positions of the carriage 601 corresponding to the support rail 107 in the Y direction. The carriage 601 is arranged such that the support rail 107 is held between the two projecting portions 702. In the present embodiment, the support rail 107 is such configured as to abut against a second slide surface 607 which is formed at upstream side in a recording sheet conveyance direction in the carriage 601. When the carriage 601 abuts against the second slide surface 607, the carriage 601 can be suppressed from being rotated on the guide shaft 108. In order to achieve an excellent slide at the slide surface between the carriage 601 and the support rail 107, the slide surface of the projecting portion 702 may be coated with a solid lubricant. Although in the present embodiment, an abutment surface abutting against the support rail 107 is formed only at the projecting portion 702 which is formed at upstream side in the recording sheet conveyance direction in the carriage 601, the present invention is not limited to this. Abutment surfaces may be formed at both of the projecting portions 702 upstream side and downstream side in the recording sheet conveyance direction in the carriage 601.

Moreover, the carriage motor 604 and an idler pulley 608 are fixed to the lower base 102 of the casing 100 in the ink jet printing apparatus 1. A carriage belt 609 is stretched between the carriage motor 604 and the idler pulley 608. The carriage 601 is disposed at a part of the carriage belt 609. In this manner, when the carriage motor 604 is driven, drive force is transmitted to the carriage 601 via the carriage belt 609. The drive force reciprocates the carriage 601 along the guide shaft 108.

A pigment ink is reserved in the ink tank 602 in the ink jet printing apparatus 1 in the present embodiment. Inside of the ink tank 602 is housed a stirring unit for stirring the ink reserved in the ink tank 602 when the ink reserved in the ink tank is stirred, as described later. A stirring plate oscillatably suspended inside of the ink tank 602, a rigid ball movably located at the bottom surface of the ink tank 602, and the like may be used as the stirring unit. The ink is stirred by the use of the stirring unit, thereby causing the ink reserved in the ink tank 602 to flow. In this manner, the ink reserved in the ink tank 602 can be more efficiently stirred. Here, although the stirring unit is housed inside of the ink tank so as to stir the ink reserved in the ink tank in the present embodiment, the present invention is not limited to this. The stirring unit need not always be disposed in the ink tank as long as the ink can be sufficiently stirred according to a change in acceleration caused by an increase or decrease in speed of the carriage when the carriage reciprocates.

Next, a description will be given of an ink stirring operation inside of the ink tank. In the present embodiment, the pigment ink containing pigment components therein is used as the ink to be ejected from the print head. Therefore, in the case where the ink remains unused for a long period of time, the pigment components may be settled in the ink. When the settlement of the pigment components is generated and thereby the concentration of the ink varies per ink droplet to be ejected, the concentration is varied at each area of the print image. As a result, the print image has color variations and concentration variations, thereby possibly degrading the quality of the print image. In view of this, the concentration of the pigment ink need be uniformly kept in the ink tank 602. In the present embodiment, the carriage 601 is reciprocated in a direction, in which the guide shaft 108 extends, at a predetermined speed and acceleration over a preset range without any ejection of the ink. In this manner, the stirring operation is performed such that the ink is stirred inside of the ink tank. The periodic ink stirring operation inside of the ink tank owing to the reciprocating motion of the carriage can uniformly keep the concentration of the ink inside of the ink tank. In this manner, the ink droplets to be ejected can suppress the ink concentration from being varied per area of the print image. Consequently, the quality of the print image can be maintained. In particular, the stirring unit such as the stirring plate or the rigid ball is housed inside of the ink tank in the present embodiment, and therefore, the stirring can be efficiently achieved.

In the present embodiment, a plurality of positions, at which the stirring operation is performed, are set within the movable range of the carriage 601. That is to say, the stirring operation is performed at the plurality of positions within the movable range of the carriage 601. Consequently, a plurality of various positions, at which the stirring operation is performed, are scattered within the movable range of the carriage 601. In this manner, the movement of the carriage 601 is controlled such that the plurality of positions, at which the stirring operation is performed, are scattered within the movable range of the carriage 601. In the present embodiment, the CPU 1000 functions as a control unit for controlling the movement of the carriage 601. The abrasion of the guide shaft 108 and the support rail 107 caused by the stirring can be uniformly dispersed within the movable range of the carriage 601. Thus, it is possible to suppress the abrasion from being concentrated at one portion caused by the repeated stirring operations at a specified position. In this manner, it is possible to suppress the abrasion from being abruptly changed somewhere in the guide shaft 108 and the support rail 107. Moreover, it is possible to suppress slidability from being largely changed somewhere. Since the slidability can be suppressed from being largely changed in the guide shaft 108 and the support rail 107, vibrations can be suppressed from occurring when the carriage 601 scans a document. The occurrence of vibrations can be suppressed when the carriage 601 scans a document, thus suppressing a distance between the surface having the ejection port in the print head formed thereat and the recording sheet from being changed. Hence, it is possible to suppress variations of a landing accuracy and variations of the concentration of the print image.

During the stirring operation, the carriage 601 reciprocates at the same position within a predetermined range. Therefore, if the stirring operation is performed only at predetermined one position within the movable range of the carriage 601, the carriage 601 slides concentratedly at one place on the guide shaft 108 and the support rail 107, and thus, it is abraded. Particularly, as the reciprocating motion is made more times in one operation, the abrasion becomes greater there. If the abrasion is concentrated at one place at the slide surface, the slidability between the carriage 601 and the guide shaft 108 or the support rail 107 is varied, and therefore, vibrations become larger when the carriage 601 is moved. In this manner, the landing accuracy of the ink onto the recording sheet is adversely influenced, thereby possibly degrading the quality of the print image.

Figure 4:
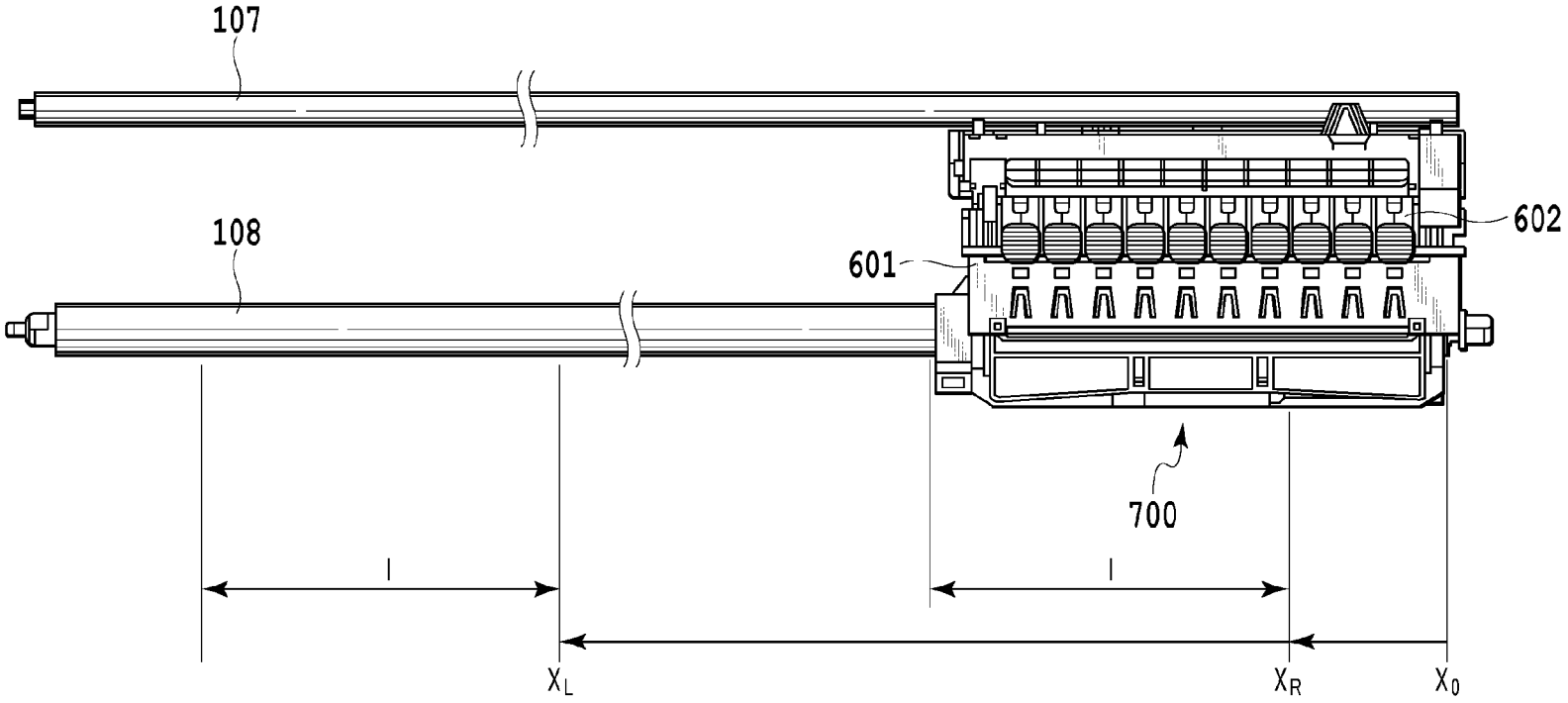
FIG. 4 is a front view schematically showing only a guide shaft, a support rail, a print head, an ink tank, and a carriage in the ink jet printing apparatus shown in FIG. 1.

Subsequently, explanation will be specifically made on the scattering of the position at which the stirring operation is performed in the X direction of the guide shaft 108. FIG. 4 is a front view showing the carriage 601, the ink tank 602, and the print head 700, wherein the stirring operation is performed at the stirring position in the axial direction of the guide shaft 108.

The stirring operation requires a predetermined acceleration at the time of the return of the reciprocating motion of the carriage 601, and therefore, a stirring distance 1 is set within a range where the acceleration can be obtained. The strength of the stirring is adjusted according to the number of times of the reciprocating motion during the stirring operation. In the present embodiment, the stirring operation can be performed at two lateral positions in the X direction. A stirring position $X_R$ indicates a right stirring operation start position in FIG. 4: in contrast, a stirring position $X_L$ indicates a left stirring operation start position in FIG. 4. Reference characters $X_R$ and $X_L$ represent distances from a reference position $X_0$ in the X direction. The stirring operation is performed within the range of the distance l from a position, at which the carriage 601 is moved by $X_R$ from the reference position $X_0$: in contrast, the stirring operation is performed within the range of the distance l from a position, at which the carriage 601 is moved by $X_L$ from the reference position $X_0$. Unless the stirring distances l overlap each other, not only the two stirring positions, as shown, but also three or more stirring positions may be set. The stirring distance l may be fluctuated according to the stirring position, or it may be constant all the time. In this manner, the plurality of stirring positions are set in the X direction, thus reducing the concentration of the abrasion of the guide shaft 108.

Figure 5:
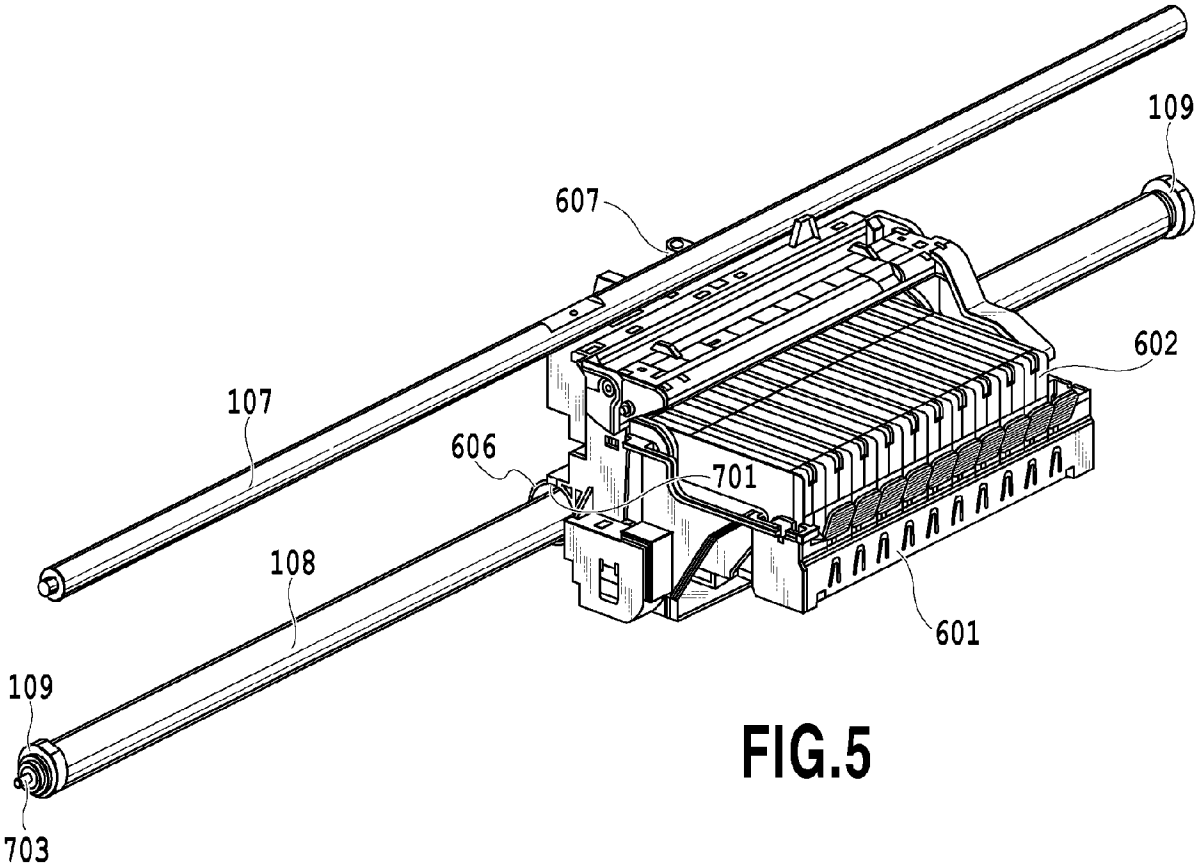
FIG. 5 is a perspective view schematically showing only the guide shaft, the support rail, the print head, the ink tank, and the carriage in the ink jet printing apparatus shown in FIG. 1.
Figure 6:
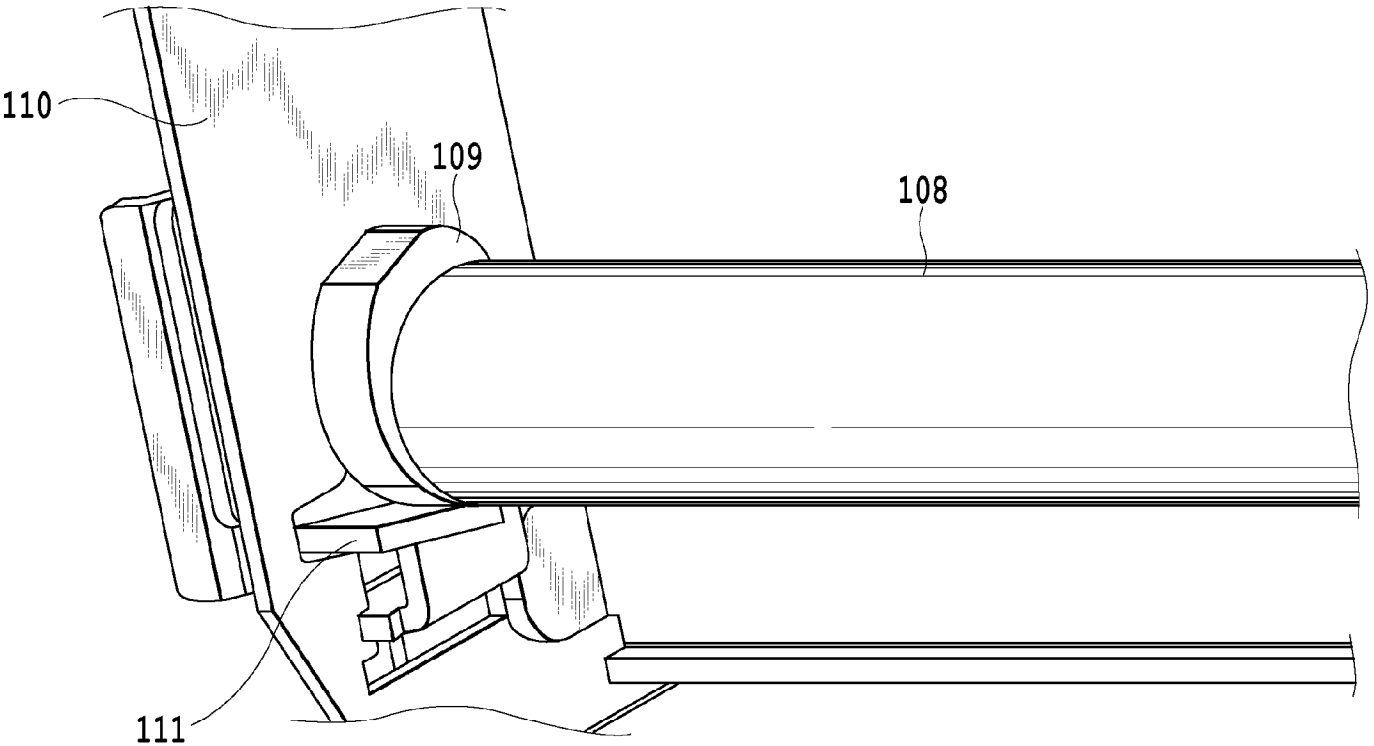
FIG. 6 is a perspective view showing the guide shaft, a guide shaft cam attached to the ink jet printing apparatus shown in FIG. 1, and a part of a chassis on the side of an ink jet printing apparatus body.

As shown in FIGS. 5 and 6, the guide shaft cams 109 are attached to both ends of the guide shaft 108. FIG. 5 is a perspective view showing the guide shaft 108, the support rail 107, the carriage 601, the print head 700, and the ink tank 602. Moreover, FIG. 6 is a perspective view showing the surroundings, at which the guide shaft 108 is fixed to the chassis 110 on the main body side of the ink jet print apparatus 1. When the guide shaft cam 109 is rotated by the rotation of the guide shaft 108, the height of the guide shaft 108 can be varied. In other words, the position of the guide shaft 108 can be varied in the Z direction. In the case where the guide shaft 108 is moved in the Z direction, the carriage 601 also is moved in the same direction accordingly. The guide shaft cam 109 has a gear coaxial with the rotational axes of the guide shaft 108 and the guide shaft cam 109. To the gear is connected a posture switching motor, not shown, via a transmission gear. As a consequence, when the posture switching motor is driven, the gear attached to the guide shaft cam 109 is rotated, so that the guide shaft cam 109 is rotated in association with the rotation of the gear. In this manner, the guide shaft cam 109 is rotated together with the rotational drive by the posture switching motor.

Additionally, the guide shaft 108 has a D-shaped shaft, with which a D-shaped hole is formed at the guide shaft cam 109 in conformity. The shaft formed at the guide shaft 108 is inserted into the hole formed at the guide shaft cam 109 in engagement with each other, so that the guide shaft cam 109 is fitted around the guide shaft 108. Since the guide shaft 108 is fitted to the guide shaft cam 109 in the above-described manner, they cannot be moved relatively to each other, and the guide shaft cam 109 is rotated together with the guide shaft 108. That is to say, the guide shaft cam 109 is securely fitted around the guide shaft 108.

FIG. 6 shows one end of each of the guide shaft 108 and the guide shaft cam 109. Here, the other end of the guide shaft 108 is formed into a shape similar to that shown in FIG. 6. In the main body of the ink jet printing apparatus 1 is disposed a shaft support plate (i.e., a support mount) 111 for supporting the guide shaft cam 109. The guide shaft cam 109 is supported on the shaft support plate 111. The guide shaft cam 109 has cam faces having different radii from the rotational center at different angles at the outer edge thereof. Therefore, the guide shaft cam 109 is rotated, thereby varying a distance between the rotational center and the shaft support plate 111.

Figure 7A:
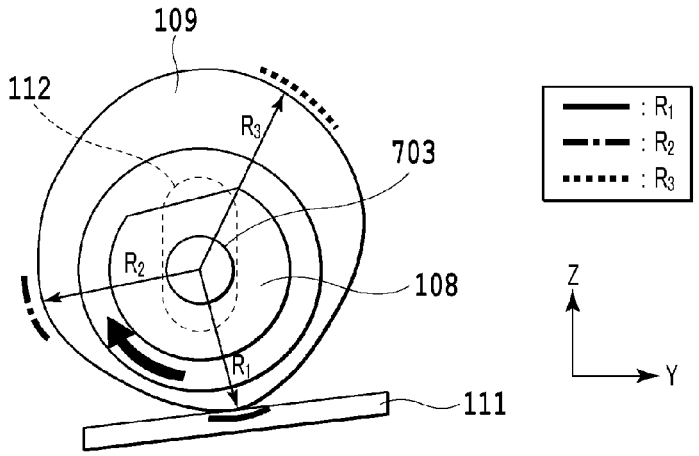
FIGS. 7A to 7C are cross-sectional views showing the guide shaft, the guide shaft cam, and a shaft support plate at varied rotational angles of the guide shaft and the guide shaft cam in the ink jet printing apparatus shown in FIG. 1.
Figure 7B:
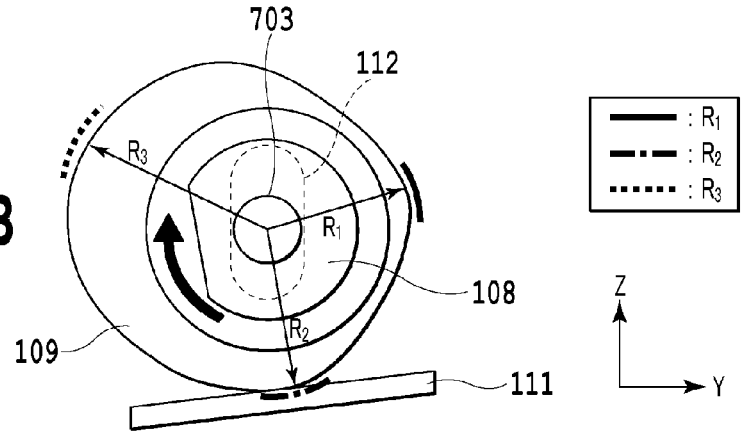
Figure 7C:
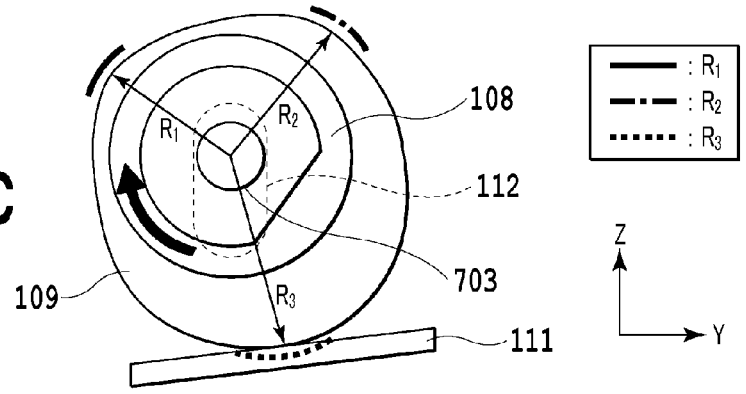

FIGS. 7A to 7C are cross-sectional views schematically showing the guide shaft 108, the guide shaft cam 109, and the shaft support plate 111 at varied angles of the guide shaft 108. As shown in FIGS. 5 and 7A to 7C, a projection 703 projecting outward of the guide shaft 108 is formed at the guide shaft 108 outside of the guide shaft cam 109 in the axial direction. The guide shaft 108 is supported by the chassis 110 in the state in which the projection 703 is inserted into a guide slit 112 formed at the chassis 110 in the casing 100. Consequently, the guide shaft 108 can be moved along the guide slit 112 in the Z direction. Specifically, when the guide shaft 108 is rotated, the distance from the shaft support plate 111 is varied by the guide shaft cam 109, thus varying the distance between the guide shaft 108 and the support surface of the platen 403. Consequently, when the guide shaft 108 is rotated, the distance between the rotational center of the guide shaft cam 109 and the shaft support plate 111 is varied while the guide shaft 108 is moved along the guide slit 112 in the Z direction. In this manner, the rotation of the guide shaft 108 varies the radius R from the rotational center of the guide shaft cam 109, thereby varying the position of the guide shaft 108 in the Z direction. At this time, the carriage 601 holding the guide shaft 108 therein also is moved in the Z direction, resulting in fluctuations of a distance between the surface having ejection ports formed at the print head 700 and the platen 403 in the Z direction.

FIGS. 7A to 7C show the variations of the radius R from the rotational center of the guide shaft cam 109 to an abutment surface against the shaft support plate 111. The smaller the radius R, the lower the position of the guide shaft 108 where a distance between the surface having the ejection ports formed at the print head 700 and a recording sheet is short. Out of the three patterns shown in FIGS. 7A to 7C, FIG. 7A shows a shortest radius R1 between the rotational center of the guide shaft cam 109 and the abutment surface against the shaft support plate 111. The position of the carriage 601 at this time is suitable for printing a photograph or the like with high accuracy. Moreover, out of the three patterns shown in FIGS. 7A to 7C, FIG. 7B shows an intermediate radius R2 between the rotational center of the guide shaft cam 109 and the abutment surface against the shaft support plate 111. The position of the carriage 601 at this time is used in printing a document or the like without any need for high accuracy. In addition, out of the three patterns shown in FIGS. 7A to 7C, FIG. 7C shows a longest radius R3 between the rotational center of the guide shaft cam 109 and the abutment surface against the shaft support plate 111. The position of the carriage 601 at this time is used in printing an image on a cardboard or replacing the ink tank 602 with a new one.

As described above, the radius R can be appropriately varied according to the usage at that time. In other words, the guide shaft 108 can vary the distance from the support surface that supports the recording sheet placed on the platen 403. The position of the guide shaft 108 is controlled to provide the plurality of distances between the guide shaft 108 and the support surface when the stirring operation is performed. In the present embodiment, the CPU 1000 controls the position of the guide shaft 108 in the Z direction. Incidentally, although the three different positions of the radius R are determined with respect to the carriage 601 in the present embodiment, the present invention is not limited to three. Four or more different positions of the radius R may be determined.

Moreover, the rotation of the guide shaft 108 varies the angle at which the guide shaft 108 is positioned so as to vary the position of a slide portion between the guide shaft 108 and the carriage 601 according to the stirring operation in the present embodiment. As a consequence, the position at which the guide shaft 108 and the carriage 601 slide on each other is scattered according to the stirring operation.

Figure 8A:
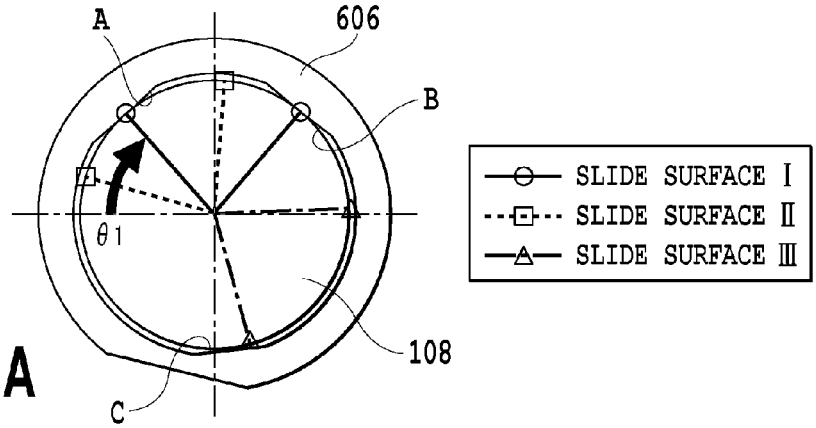
FIGS. 8A to 8C are cross-sectional views showing the guide shaft and a carriage bearing at varied rotation angles of the guide shaft in the ink jet printing apparatus shown in FIG. 1.
Figure 8B:
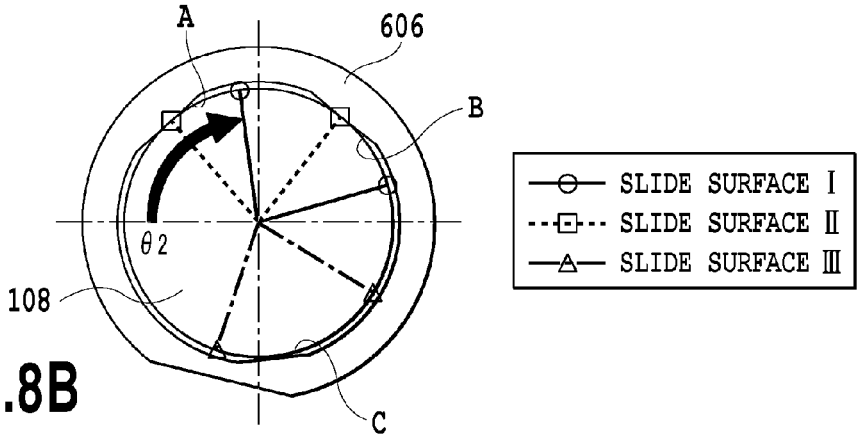
Figure 8C:
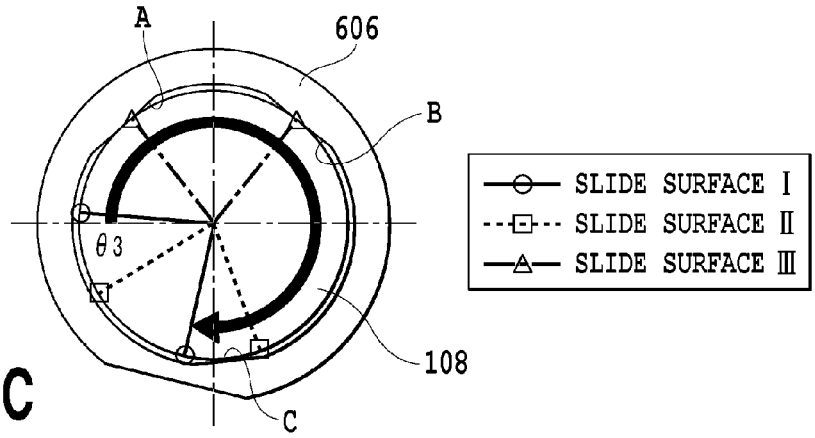

Subsequently, a description will be specifically given of the scattering of the slide surface between the guide shaft 108 and the inner surface of the carriage bearing 606 due to the rotation of the guide shaft 108. FIGS. 8A to 8C are cross-sectional views schematically showing the guide shaft 108 and the carriage bearing 606 at the varied angles of the guide shaft 108 when the guide shaft 108 changed the angle. The cross section perpendicular to an axis, of the inner surface of the carriage bearing 606 is formed into a substantially circular shape. Moreover, a partially linear chord is formed at the inner surface of the carriage bearing 606. The distance from the center of the guide shaft 108 to the inner surface of the carriage bearing 606 is short at the chord. Therefore, the inner surface of the carriage bearing 606 slides on the outer peripheral surface of the guide shaft 108 at the linear chord in contact with each other. In the present embodiment, three linear chords are formed at the inner surface of the carriage bearing 606.

The guide shaft 108 is formed such that it can be rotated relatively to the carriage bearing 606 of the carriage 601. Consequently, the guide shaft 108 is rotated relatively to the carriage bearing 606, thereby varying the position of the slide surface, at which the outer periphery of the guide shaft 108 slides on the inner surface of the carriage bearing 606. In other words, the rotation of the guide shaft 108 is controlled such that the guide shaft 108 is rotated relatively to the carriage bearing 606 in the carriage 601 at the plurality of angles during the stirring operation. In the present embodiment, the CPU 1000 controls the rotation of the guide shaft 108.

FIGS. 8A to 8C show the rotational angles of the guide shaft 108 in various states, wherein θ designates an angle from a reference position in the rotational direction of the guide shaft 108. It is assumed that the guide shaft 108 takes an angle θ1 at the radius R1 from the rotational center of the guide shaft cam 109; it takes an angle θ2 at the radius R2; and it takes an angle θ3 at the radius R3. As the guide shaft 108 is rotated, it reaches a slide surface A, B, or C from the reference position.

FIG. 8A shows the state where the rotation of the guide shaft 108 corresponding to the angle θ1 moves a slide surface I of the guide shaft 108 from the reference position so as to reach a first contact portion A between the guide shaft 108 and the bearing 606. Here, in FIG. 8A, the slide surface of the guide shaft 108 sliding on the contact portions A and B is referred to as the slide surface I. FIG. 8B shows the state where the rotation of the guide shaft 108 corresponding to the angle θ2 moves the slide surface I of the guide shaft 108 from the reference position so as to pass a second contact portion B between the guide shaft 108 and the bearing 606. Here, in FIG. 8B, the slide surface of the guide shaft 108 sliding on the contact portions A and B is referred to as a slide surface II. FIG. 8C shows the state where the rotation of the guide shaft 108 corresponding to the angle θ3 moves the slide surface I of the guide shaft 108 from the reference position so as to pass a third contact portion C between the guide shaft 108 and the bearing 606. Here, in FIG. 8C, the slide surface of the guide shaft 108 sliding on the contact portions A and B is referred to as a slide surface III.

The guide shaft 108 is rotated at the various angles θ1 to θ3, thereby moving the portion in contact with the carriage bearing 606 at the outer periphery of the guide shaft 108. The number of rotational angles θ is arbitrary. In this manner, the rotation of the guide shaft 108 varies the rotational angle, thus permitting to scatter the position at which the carriage bearing 606 slides on the outer peripheral surface of the guide shaft 108.

Next, the scattering in the Z direction at the slide surface between the support rail 107 and the carriage 601 will be described with reference to FIGS. 9A to 9C. FIGS. 9A to 9C are side views showing each of the slide surface between the support rail 107 and the carriage 601 when the positional relationship between the carriage 601 and the support rail 107 is varied in the Z direction. In the present embodiment, the two projecting portions 702 projecting from the upper surface of the carriage 601 hold the support rail 107 therebetween. Therefore, the support rail 107 suppresses the rotation of the carriage 601, and therefore, holds the posture of the carriage 601. In the present embodiment, the two projecting portions 702 arranged in the Y direction hold the support rail 107 therebetween. Consequently, the carriage 601 can be freely moved in the Z direction since the movement of the carriage 601 in the Z direction is not prevented. In this manner, the guide shaft 108 is moved in the Z direction, so that the carriage 601 can be moved in the Z direction. This can move the position of the slide portion contacting to the support rail 107 at the projecting portions 702 of the carriage 601, thereby scattering the position of the slide portion. As a result, the abrasion of the second slide surface 607 at the carriage 601 can be scattered.

The rotation of the guide shaft cam 109 moves the position of the rotational center of the guide shaft cam 109 in the Z direction. Accordingly, the carriage 601 is moved in the Z direction. At this time, the slide portion between the support rail 107 and the carriage 601 is moved within the second slide surface 607 according to the fluctuation of the height of the carriage 601.

The position of the carriage 601 in the Z direction is designated by Z1 at the radius R1, shown in FIG. 7A, from the rotational center of the guide shaft 108 to the abutment surface between the guide shaft cam 109 and the shaft support plate 111. Moreover, the position of the carriage 601 in the Z direction is designated by Z2 at the radius R2 shown in FIG. 7B. Additionally, the position of the carriage 601 in the Z direction is designated by Z3 at the radius R3 shown in FIG. 7C. At this time, the position of the carriage 601 in the Z direction in FIG. 9A is designated by Z1; the position of the carriage 601 in the Z direction in FIG. 9B is designated by Z2; and the position of the carriage 601 in the Z direction in FIG. 9C is designated by Z3. In this manner, in the present embodiment, the carriage 601 is moved in the Z direction relatively to the support rail 107 fixed to the chassis 110, thus fluctuating the position at which the support rail 107 slides on the second slide surface 607.

As described above, the guide shaft 108 is moved so as to vary the distance between the support surface of the platen 403 and the guide shaft 108, so that the carriage 601 is moved so as to vary the distance from the support surface and the guide shaft 108. At this time, the carriage 601 slides on the support rail 107 so that posture of the carriage 601 is held in such a manner that any rotation on the guide shaft 108 at the carriage bearing 606 is prevented. Here, the position of the guide shaft 108 in the carriage 601 is controlled such that there are a plurality of slide portions sliding on the support rail 107 within the second slide surface 607. Varying the position of the guide shaft 108 in the Z direction varies the position of the carriage 601 in the Z direction. Accordingly, the slide portion sliding on the support rail 107 in the carriage 601 is varied within the second slide surface 607. At this time, the CPU 1000 controls the position of the slide portion sliding on the support rail 107 in the carriage 601 during the stirring operation.

Incidentally, the position of the carriage 601 in the Z direction is not limited to the above-described three positions. The number of positions is arbitrary within a movable range of the carriage 601.

In this manner, the plurality of positions of the carriage 601, in the direction in which the guide shaft 108 extends, and the plurality of rotational angles of the guide shaft 108 are set when the stirring operation is performed in the present embodiment. Moreover, the rotational angle of the guide shaft 108 is fluctuated, and accordingly, the slide portion between the carriage bearing 606 and the guide shaft 108 and the position of the carriage 601 in the Z direction are fluctuated. In the present embodiment, a plurality of stirring modes are set in each combination. Among these set stirring modes, the suitable stirring mode for each of situations is selected.

Specifically, in the present embodiment, a plurality of positions where the stirring operation is performed are previously set. When the stirring mode is selected, the position of the stirring operation in the main scan direction, in which the guide shaft 108 extends, is selected from the plurality of set positions. Additionally, the plurality of rotational angles of the guide shaft 108 relative to the carriage 601 at the time of the stirring operation are previously set. Therefore, when the stirring mode is selected, the rotational angle of the guide shaft 108 relative to the carriage 601 is selected from the plurality of set rotational angles. In addition, the plurality of distances between the guide shaft 108 and the support surface of the platen 403 during the stirring operation are previously set. Therefore, when the stirring mode is selected, the distance between the guide shaft 108 and the support surface of the platen 403 is selected from the plurality of set distances. Furthermore, the plurality of slide portions contacting to the support rail 107 in the carriage 601 during the stirring operation are previously set within the second slide surface 607. Therefore, when the stirring mode is selected, the slide portion contacting to the support rail in the carriage 601 is selected from the plurality of set slide portions.

Explanation will be made below on the stirring mode that is selected in each case. Here, it is assumed that the stirring is not performed at the position of the carriage 601 where a photograph or the like requiring a high print accuracy is printed. Therefore, the position at the radius R1 of the guide shaft cam 109 from the rotational center is not used. As illustrated in FIG. 10, stirring modes Type A, Type B, Type C, and Type D using the radii R2 and R3 and stirring positions R and L are set in each case.

FIG. 10 illustrates the positions and states of the guide shaft 108 and carriage 601 in each of the stirring modes. Specifically, FIG. 10 illustrates the radius R to the abutment surface against the shaft support plate 111 in the guide shaft cam 109, the position of the carriage 601 in the X direction, the rotational angle of the guide shaft 108 from a reference position, and the position of the carriage 601 in the Z direction at the time of the stirring operation.

In the stirring mode Type A, there is a combination of the radius R2, the stirring position $X_R$, the rotational angle θ2, and Z2. In the stirring mode Type B, there is a combination of the radius R2, the stirring position $X_L$, the rotational angle θ2, and Z2. In the stirring mode Type C, there is a combination of the radius R3, the stirring position $X_R$, the rotational angle θ3, and Z3. In the stirring mode Type D, there is a combination of the radius R3, the stirring position $X_L$, the rotational angle θ3, and Z3.

The stirring operation is performed at a timing according to a lapse of time after the previous stirring operation in order to prevent the concentration of the ink to be ejected from being changed caused by the settlement of the pigment components contained in the ink reserved in the ink tank. Moreover, the stirring operation is performed simultaneously with the replacement of the ink tank or the recovery of the print head. The optimum number of times of reciprocating motions during the stirring operation is selected according to the condition in each stirring operation.

Furthermore, it is preferable that the stirring operation should be performed simultaneously with specific operations such as inputting data on a print command so as not to prevent a printing operation, if possible. In this way, it is unnecessary to take time only for the stirring, thereby reducing a user's latency required for the stirring operation.

In the present embodiment, the stirring operation may be manually performed by a user at any timing. In addition, the stirring operation may be performed immediately after the ink tank 602 having no ink therein is replaced with a new one. Moreover, the stirring operation may be performed during the recovery operation for keeping the ink ejection by the print head in an excellent state. Furthermore, the stirring operation may be performed during interruption by a timer for the purpose of the maintenance of the quality of the ink reserved in the ink tank in the case of no command during a predetermined period of time in the state in which the power source is ON in the ink jet printing apparatus 1. Additionally, the stirring operation may be performed at the time of ON of the power source during initialization immediately after the power source is turned on in the printing apparatus by pressing the power source key 104. FIG. 11 illustrates the combinations between the above-described stirring timings: 1. manual stirring; 2. access cover closure; 3. print head capping; 4. timer interruption; and 5. power ON and the stirring modes at each of the timings.

In the present embodiment, predetermined stirring mode is set according to the timings at which the stirring operation is performed. FIG. 11 is a table illustrating the combinations between the stirring timings at which the stirring operation is performed and the stirring modes set according to the stirring timings. The stirring mode Type D is selected at the stirring timing of the manual stirring. Moreover, the stirring mode Type C is selected at the stirring timing when the stirring operation is performed simultaneously with the replacement of the ink tank. In addition, the stirring timing Type A is selected at the stirring timing when the stirring operation is performed simultaneously with the recovery of the ejection state in the print head. Additionally, the stirring mode Type B is selected at the stirring timing of the timer interruption. Furthermore, the stirring mode Type A is selected when the stirring operation is performed while the power source is kept ON for a predetermined period of time without any command.

The stirring mode selected from the above described combinations may be changed according to the state of the print head, the residual amount of ink, the lapse of time, or the head recovery timing. Moreover, the stirring mode need not take the one-to-one relationship with the stirring timing all the time, as illustrated in the table. For example, when many stirring operations at a specified position are detected in the case where the number of times of reciprocating motions at each of the positions of the carriage 601 that performs the stirring operation is counted, the stirring operation may be performed in another stirring mode. In other words, in the case where the stirring operation has already performed many times at the position, the stirring operation may be performed in a stirring mode other than that designated based on the table even if the stirring operation is to be performed in the same stirring mode based on the table. The stirring mode may be switched in a round-robin manner in order to scatter the slide surface. Alternatively, the stirring mode may be selected at random by using random numbers.

In the above-described embodiment, the plurality of stirring modes, in which the stirring operation is performed, are provided. Therefore, the stirring mode set at each timing can be selected from the plurality of stirring modes. In this manner, the slide surface between the carriage 601 and the guide shaft 108, the slide surface between the carriage 601 and the support rail 107, and the slide portions of the guide shaft 108 in the X direction can be scattered, so that the abrasion of the slide surfaces can be averaged. Consequently, it is possible to stabilize the reciprocating motion of the carriage 601 so as to suppress the degradation of landing accuracy by ink droplets.

Incidentally, the term "print" is used for forming not only an image of significant information on a character or graphics but also an image of insignificant information in this specification. Moreover, the term "print" signifies forming an image, a design, a pattern, and the like on a print medium or processing the print medium irrespective of whether or not an image is developed so as to make a person visually perceive it.

Additionally, the term "printing apparatus" is applicable to not only a single function printer but also a composite machine equipped with print functions including a copying function, a facsimile function, and the like. The "printing apparatus" includes apparatuses equipped with a print function such as a printer, a printer composite machine, a copying machine, and a facsimile apparatus and a fabricating apparatus that fabricates a product by using an ink jet technique.

Furthermore, the term "recording sheet" represents not only a sheet for use in a typical printing apparatus but also materials capable of receiving ink such as fabric, a plastic film, a metallic plate, glass, ceramics, wood, and leather.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-106984, filed May 8, 2012, which is hereby incorporated by reference herein in its entirety.

What is claimed is:

1. A printing apparatus comprising:

a carriage holding a print head and an ink tank, configured to reciprocate along a guide in a direction; and a controller for performing stirring of ink in the ink tank by reciprocating the carriage within a limited range without ejecting the ink from the print head, wherein the controller performs the stirring with a selected one of a first mode to reciprocate the carriage with a first limited range and a second mode to reciprocate the carriage with a second limited range which is not overlapped with the first limited range in the direction.

2. The printing apparatus according to claim 1, further comprising:

a shaft, configured to support the carriage, to which a part of the carriage contacts while reciprocating; and a mechanism configured to change a height of the carriage with respect to a platen on which a sheet to be printed is supported, wherein, for the stirring, a portion of the part of the carriage that contacts the shaft is changeable according to the height of the carriage with respect to the platen.

3. The printing apparatus according to claim 2, wherein when the height of the carriage with respect to the platen is set to be smallest, the stirring is not performed.

4. The printing apparatus according to claim 2, further comprising a support mount for supporting a cam that is fitted to the shaft, wherein the distance between the shaft and the support mount is changed by the cam when the shaft is rotated, thus changing the height of the carriage with respect to the platen.

5. The printing apparatus according to claim 1, wherein the ink stored inside of the ink tank contains pigment components.

6. A printing apparatus comprising:

a carriage holding a print head and an ink tank, configured to reciprocate by being guided by a guide shaft in a direction; and a controller for performing stirring of ink in the ink tank by reciprocating the carriage within a limited range without ejecting the ink from the print head, wherein, for the stirring, a location of the limited range in the direction and a rotational angle of the guide shaft are changeable.

7. The printing apparatus according to claim 6, further comprising:

a sub-shaft, configured to support the carriage, to which a part of the carriage contacts while reciprocating; and a mechanism configured to change a height of the carriage with respect to a platen on which a sheet to be printed is supported, wherein, for the stirring, a portion of the part of the carriage that contacts the sub-shaft is changeable according to the height of the carriage with respect to the platen.

8. The printing apparatus according to claim 7, wherein when the height of the carriage with respect to the platen is set to be smallest, the stirring is not performed.

9. The printing apparatus according to claim 7, further comprising a support mount for supporting a cam that is fitted to the sub-shaft; wherein the distance between the sub-shaft and the support mount is changed by the cam when the sub-shaft is rotated, thus changing the height of the carriage with respect to the platen.

10. The printing apparatus according to claim 6, wherein the ink stored inside of the ink stored inside of the ink tank contains pigment components.

* * * * *